US006248115B1

(12) United States Patent
Halk

(10) Patent No.: US 6,248,115 B1
(45) Date of Patent: Jun. 19, 2001

(54) DEPILATORY DEVICE

(76) Inventor: Dennis Halk, 20 Wildwood Place, Waterloo, Ontario (CA), N2L4B1

( * ) Notice: Subject to any disclaimer, the term of this patent is extended or adjusted under 35 U.S.C. 154(b) by 0 days.

(21) Appl. No.: 09/346,115

(22) Filed: Jul. 1, 1999

(51) Int. Cl.[7] ..... A61B 17/50
(52) U.S. Cl. ..... 606/133; 606/131; 132/76.4
(58) Field of Search ..... 606/133, 36, 43, 606/131; D28/10, 44, 44.1, 59; D24/143, 133; 132/73, 76.4, 76.5; 451/527, 533, 534, 539

(56) References Cited

U.S. PATENT DOCUMENTS

| | | | | |
|---|---|---|---|---|
| D. 19,185 | | 6/1889 | Pray . | |
| D. 63,234 | * | 11/1923 | Nevius | D28/59 |
| D. 110,252 | * | 6/1938 | Lewis | D28/44.1 |
| D. 201,168 | | 5/1965 | Milton et al. . | |
| D. 240,588 | | 7/1976 | Franzen et al. . | |
| D. 253,851 | | 1/1980 | Sperry . | |
| D. 260,304 | * | 8/1981 | Rosenberg | D28/59 |
| D. 281,729 | * | 12/1985 | Mast | D28/59 |
| D. 282,591 | | 2/1986 | Usem et al. . | |
| D. 282,592 | * | 2/1986 | Usem et al. | D28/59 |
| D. 405,919 | | 2/1999 | Halk . | |
| 742,639 | | 10/1903 | Harlan . | |
| 878,881 | * | 2/1908 | Hopkins | 132/76.4 |
| 945,061 | | 1/1910 | Tener . | |
| 1,477,274 | * | 12/1923 | Mallory | 132/76.4 |
| 1,748,008 | | 2/1930 | Barnowitz . | |
| 4,286,610 | * | 9/1981 | Jones et al. | 132/76.4 |
| 4,343,910 | | 8/1982 | Busch, Jr. et al. . | |

* cited by examiner

*Primary Examiner*—Pedro Philogene
(74) *Attorney, Agent, or Firm*—Howell & Haferkamp, L.C.

(57) ABSTRACT

A depilatory device comprises a body with an integral, deformable finger hold on the top, an abrasive surface on the bottom, and contours having generally pointed projections and corners to facilitate the removal of hair from confined or difficult to reach parts of the body.

26 Claims, 3 Drawing Sheets

DEPILATORY DEVICE

BACKGROUND OF THE INVENTION (1) Field of the Invention

The invention pertains to a hair removal or depilatory device for use on the body. In particular, the device pertains to a hand-held and manually manipulated depilatory device. These types of depilatory devices have at least one abrasive surface. The depilatory device removes the hair by rubbing or buffing the abrasive surface against the body where hair removal is desired. The result of using the device allows hair removal without pain, odor, chemicals or mess.

(2) Description of the Related Art

Over the years, many devices have been developed to remove unwanted hair and skin from the body via an abrasive means. The abrasive surfaces of the prior art devices are typically symmetrical along both a longitudinal axis in length and a lateral axis in width. The contour of the abrasive surface is usually smooth and without any protrusions or projections. The prior art devices typically are hand-held and manipulated and accordingly incorporate some method for gripping and handling the device via the hand or fingers. Additionally, the prior art devices' abrasive surface is typically flat or planer although, some of the prior art devices are comprised of a curved or rounded abrasive surface.

As stated earlier, the prior art devices are typically symmetrical along both their longitudinal length and lateral width. A disadvantage of the symmetry is that both sides serve the same purpose as the other in regards to its ability to conform to and reach areas on the body.

Prior art devices typically have an abrasive surface whose contour is smooth or gently curving and do not have any projections or protrusions. These devices usually have an abrasive surface that has either rounded ends, squared ends, or squared ends with rounded corners. A disadvantage of these prior art configurations is that the contours of the abrasive surface do not allow for convenient access to and removal of hair or skin in confined or difficult to reach crevices or locations upon the body. Additionally, accurate removal of hair from locations where maintaining a defined hairline is desirable is difficult with the prior art devices. These disadvantages of the prior art devices can be overcome by a device having ends of different sizes to allow for the removal of hair in large unobstructed areas with the larger end while the user can utilize the smaller end for tighter or more confined, difficult to reach locations of hair removal. Additionally, the different size ends would allow the use of the smaller end for hair removal where accuracy is more important than quickness.

Prior art devices typically have a hand or finger hold. These can range from allowing the user to hold and manipulate the device with a few fingers to requiring the use of the entire hand. Some prior art devices have handles that are collapsible or removable. The prior art devices typically utilize a rigid hand or finger hold. A disadvantage of these prior art devices' hand or finger holds is that the shape or configuration of the hand or finger hold is not always conducive to sustained gripping and manipulation. Additionally, the hand or finger holds of the prior art devices that are flexible are not contoured to conform to the configuration of the fingers. Thus continued manipulation of the device can lead to fatigue or pain in the hand or fingers. These disadvantages of the hand or finger holds of the prior art can be overcome by designing a finger hold that is flexible and/or conforms to the contours of the fingers.

SUMMARY OF THE INVENTION

The present invention provides a device for removing hair from the body, but may also be employed in any application that requires removal of hair or skin cells from the body via an abrasive method. The device is basically comprised of a body, a finger hold, and an abrasive surface. The device has a bottom surface that is generally flat. The bottom surface may also be curved or rounded and still perform the desired function of the device. The abrasive surface of the device can be integral to the bottom surface or can be a separate abrasive sheet that can be secured to the bottom surface of the device. The use of a separate abrasive sheet allows for the removal of worn-out abrasive sheets and replacement with a new abrasive sheet thus increasing the useful life of the device. Use of a removable and replaceable abrasive sheet further allows for the device to be used in applications requiring differing levels of abrasion. That is, different abrasive sheets can employ differing levels of coarseness depending upon the desired application, thereby increasing the versatility of the device.

In the preferred embodiment, the abrasive sheet has an adhesive backing that is utilized to secure the abrasive sheet to the bottom surface of the device. However, in alternate embodiments, the sheet may be secured to the bottom surface by other suitable means.

The present device has opposing ends of unequal surface area. The advantage of having unequal surface areas on opposing ends of the device is that it allows for more efficient removal of hair from easily accessible and large areas of the body by utilizing the end having a larger surface area. The smaller surface area or narrower end can then be utilized in areas requiring finer or closer attention to detail where the accuracy of the hair removal is more important than the quickness of hair removal.

The device has an abrasive surface whose contour includes generally pointed projections. The generally pointed projections of the abrasive surface allows for the removal of hair in difficult to reach locations on the body. The contour allows the user to reach confined areas or crevices on the body with the generally pointed projections of the abrasive surface that can not be reached by an abrasive surface having the contours of the prior art. The device also has generally pointed corners. The generally pointed corners also facilitate hair removal in difficult to reach locations on the body. In addition, these abrasive projections and corners also allow for the accurate removal of hair from areas where the removal of hair from specific locations and not other locations is important, such as where a well defined hairline is desired.

The finger hold of the device is designed to facilitate the rubbing and buffing motion employed in the removal of hair or skin. The finger hold is tapered inwardly as it extends longitudinally to facilitate comfort and the transfer of force from the fingers to the device. The finger hold also tapers inwardly as it extends upwardly from the top surface of the device. This tapering also aides in the comfort experienced by the user when manipulating the device by providing a secure grip on the device. The finger hold is recessed in the middle of the device where the bottom surface of the device is at its smallest lateral width. The finger hold smallest lateral width dimension, is laterally smaller than the smallest lateral width dimension of the bottom surface immediately below the finger hold. From the location on the finger hold where it is at its smallest lateral width, the finger hold flares laterally outwardly as it extends longitudinally towards the opposing ends of the device. The recessed finger hold allows for removal of hair from tight or confined areas without the user's fingers obstructing or interfering with the ability of the abrasive surface to reach these difficult areas. The finger hold is also designed with generally parallel webbed members or grips that deform from the pressure of the user's fingers to create a more comfortable and efficient means to manipulate the device.

The device is made of a pliable material such as rubber or any other suitable material. The pliable nature of the material allows the device to deform in order to conform to the surface features and contours of the body where hair or skin removal is desired. The device may also be made of a rigid material, such as a hard plastic or any other suitable material, where deformation of the device and conformation to the surface features and contours of the body is not desirable or necessary.

BRIEF DESCRIPTION OF THE DRAWINGS

Further objects and features of the device are set forth in a detailed description of the preferred embodiments of the device and in the drawing figures wherein.

DESCRIPTION OF THE PREFERRED EMBODIMENT

Figure 1:
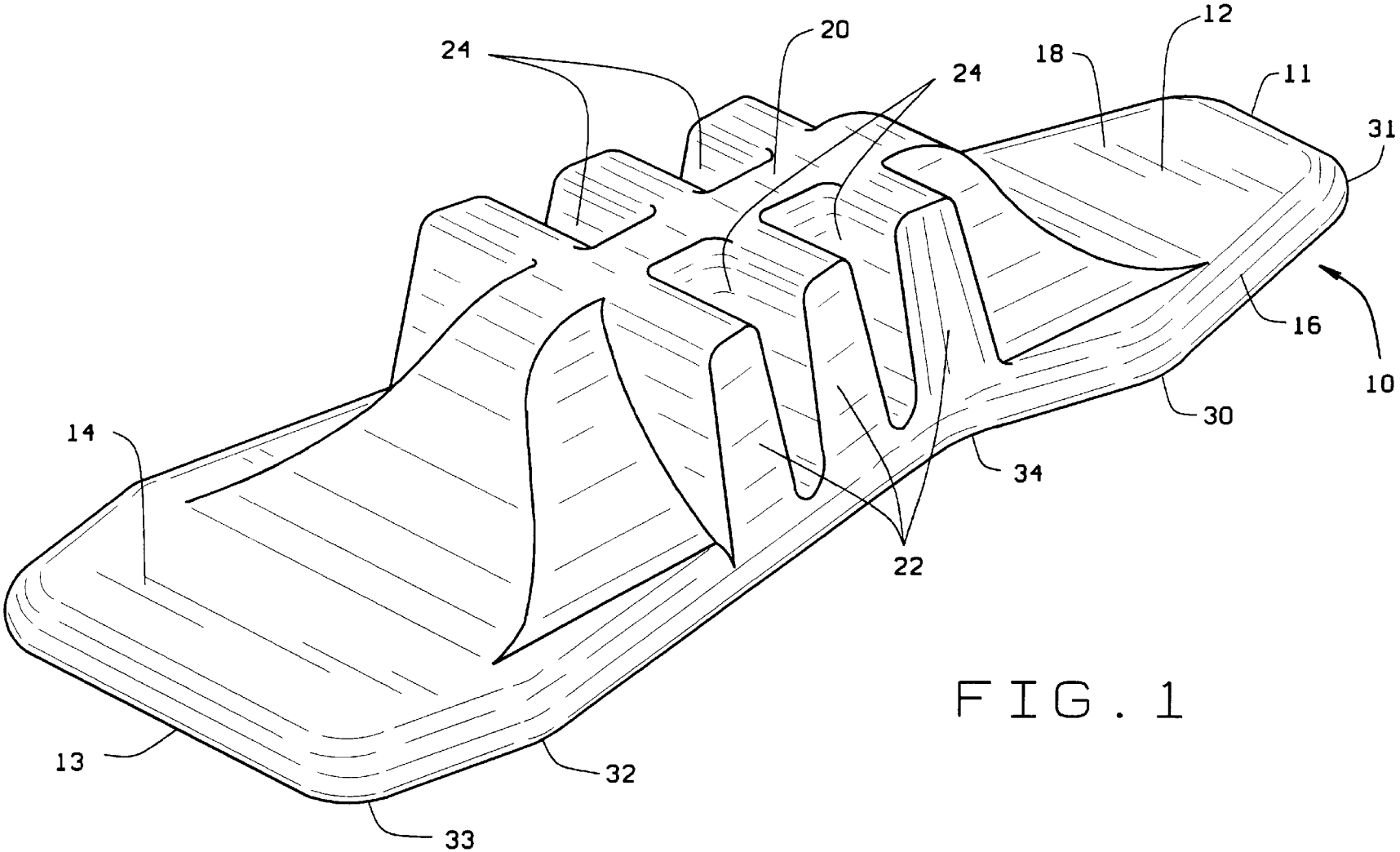
FIG. 1 is a perspective view of a depilatory device of the invention.
Figure 2:
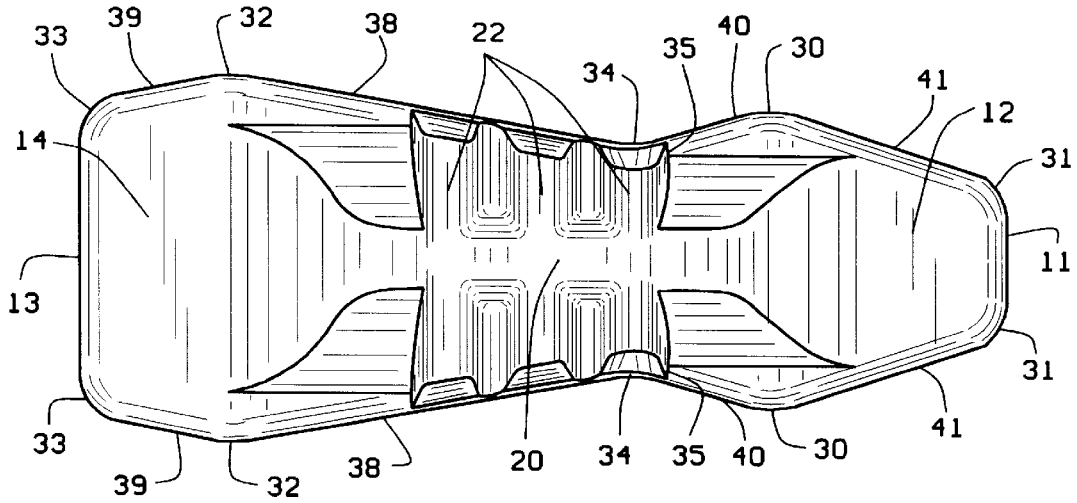
FIG. 2 is a top plan view of the device of FIG. 1.
Figure 3:
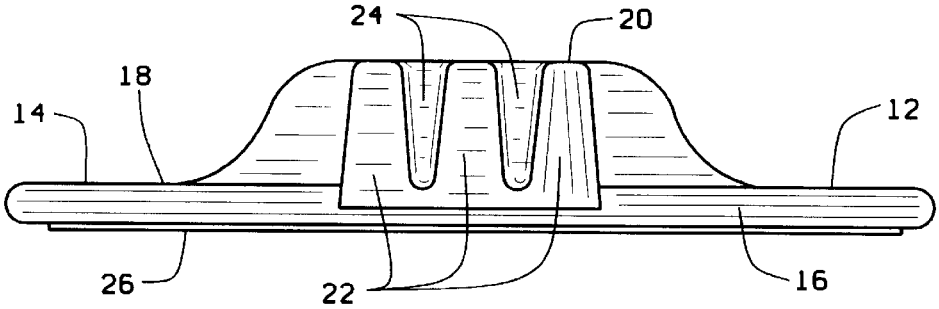
FIG. 3 is a side elevation view of the device illustrating the side edge and slots between the webbed members of the finger hold.

FIGS. 1–6 illustrate the features of the device. It should be understood that this embodiment of the device is employed for illustrative purposes only and that other embodiments exist which are intended to be covered by the claims and disclosure of this device.

Referring to the drawings, a depilatory device according to the invention is generally designated 10. The device has a longitudinal length between opposite laterally extending first 11 and second 13 edges and a lateral width between opposite longitudinally extending side edges 16. The first 11 and second 13 edges and the side edges 16 separate a top surface 18 of the device from a bottom surface 26 of the device. The bottom surface 26 is generally smooth and an abrasive sheet 28 is secured on the surface to form an abrasive surface on the depilatory device 10. The abrasive sheet 28 is removable and a new or different abrasive sheet 28 may be attached to the bottom surface 26. In an alternate embodiment, the abrasive sheet 28 is not removed, but rather a new abrasive sheet 28 is attached on top of the existing or worn-out abrasive sheet 28. The abrasive sheet 28 may be of any coarseness suitable for the desired application. The abrasive sheet 28 may also have areas of different coarseness on the same sheet. In an alternate embodiment, the depilatory device 10 has a bottom surface 26 which is abrasive. The depilatory device 10 is further comprised of a first end 12 whose lateral width is smaller than the lateral width of a second end 14.

On the top surface 18 there is an integral finger hold 20. The finger hold 20 is comprised of a plurality of laterally oriented parallel webbed members 22 separated by slots 24. The number of laterally oriented parallel webbed members 22 may be any number greater than one. Preferably, the finger hold 20 is constructed of a pliable material to facilitate deformation under the pressure of being gripped by the user's fingers. In addition, as can best be seen in FIGS. 5 or 6, the finger hold 20 is preferably tapered 36 laterally inwardly as it extends upwardly. As can best be seen in FIG. 2, the finger hold 20 flares 38 laterally outwardly as it extends longitudinally from the smallest lateral width portion 34 of the bottom surface 26 towards the second end 14. In addition, the finger hold 20 also flares 40 laterally outwardly as it extends longitudinally from the smallest lateral width portion 34 of the bottom surface 26 towards the first end 12.

Figure 4:
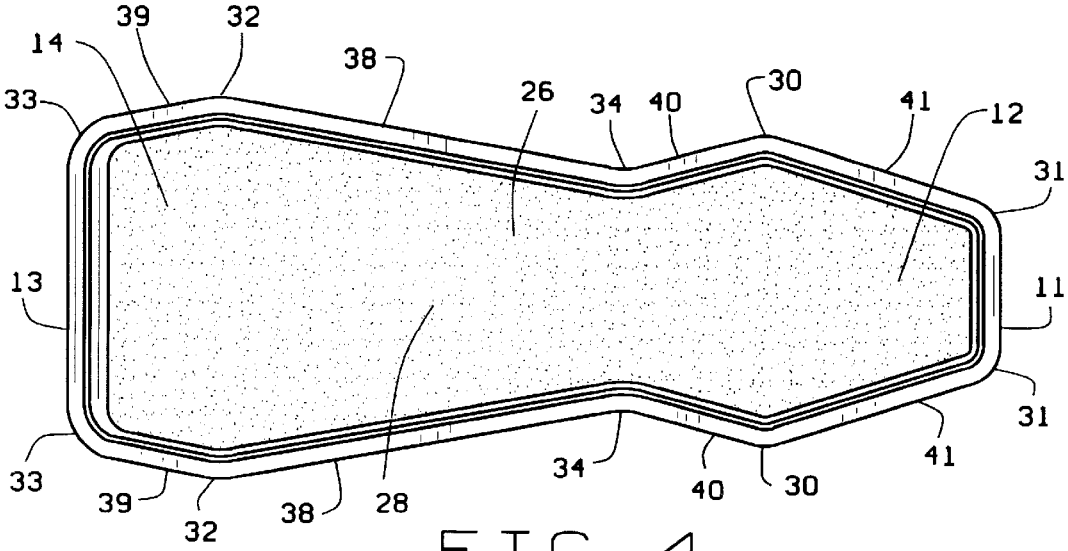
FIG. 4 is a bottom plan view of the device with the abrasive surface being integral to the device or with the abrasive sheet secured to the bottom of the device.
Figure 5:
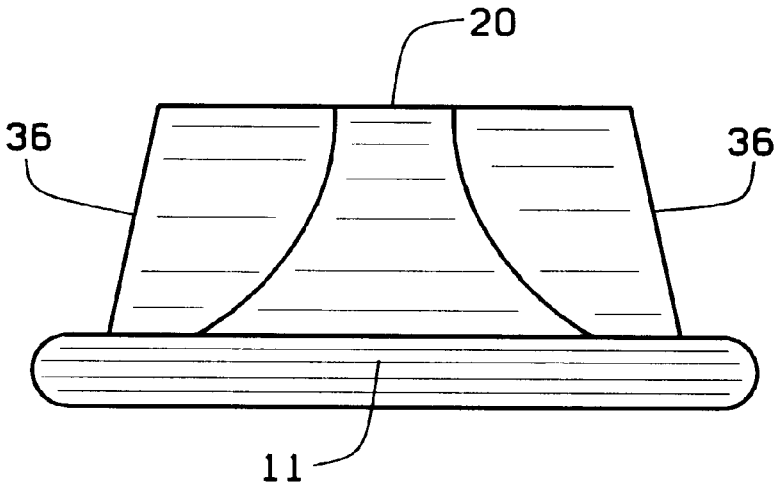
FIG. 5 is an end elevation view of the device looking at the first end or right hand end of FIG. 2.
Figure 6:
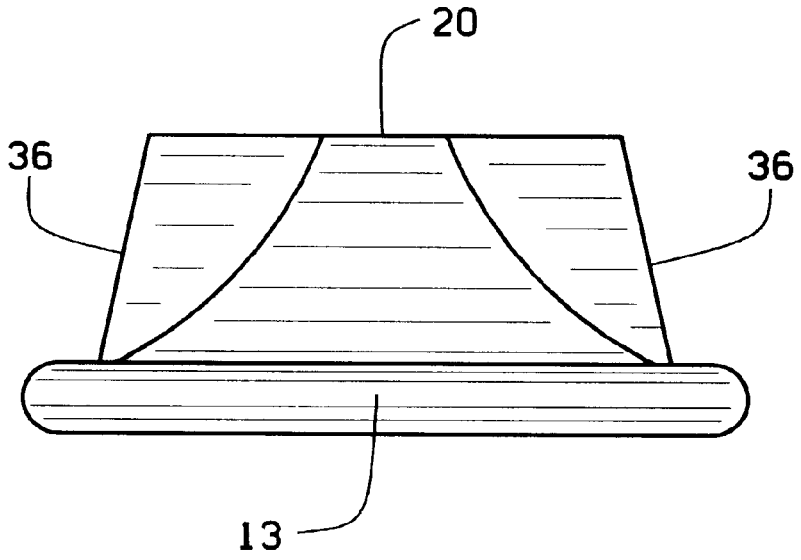
FIG. 6 is an end elevation view of the device looking at the second end or left hand end of FIG. 2.

As can best be seen in FIG. 4, the side edges 16 flare 40 laterally outwardly and then taper 41 laterally inwardly as they extend longitudinally from the smallest lateral width portion 34 of the bottom surface 26 towards the first lateral edge 11. The flaring 40 and subsequent tapering 41 form generally pointed projections 30 with which the device may reach into tight or confined crevices or features of the body. The generally pointed projections 30 may range from being a gentle curve in one embodiment to a pointed protrusion in another embodiment or any variation in between. The tapering 41 of the side edges 16 form generally pointed corners 31 when combining with the first lateral edge 11. These generally pointed corners 31 provide even greater access to tight or confined crevices or features of the body than the generally pointed projections 30. The generally pointed corners 31 may range from being gently curving in one embodiment to sharply pointed in another embodiment or any variation in between. The tapering 41 of the side edges 16 combine with the first lateral edge 11 to form a generally blunt first lateral edge 11. In an alternative embodiment, the tapering 41 of the side edges 16 in combination with the first lateral edge 11 may form a pointed first lateral edge 11 or any variation between pointed and blunt.

The side edges 16 flare 38 laterally outwardly and then taper 39 laterally inwardly as they extend longitudinally from the smallest lateral width portion 34 of the bottom surface 26 towards the second lateral edge 13. The flaring 38 and subsequent tapering 39 of the side edges 16 form generally pointed projections 32 with which the device may reach into tight or confined crevices or features of the body. The generally pointed projections 32 may range from being a gentle curve in one embodiment to a pointed protrusion in another embodiment or any variation in between. The tapering 39 of the side edges 16 form generally pointed corners 33 when combining with the second lateral edge 13. These generally pointed corners 33 provide even greater access to tight or confined crevices or features of the body than the generally pointed projections 32. The generally pointed corners 33 may range from being gently curving in one embodiment to sharply pointed in another embodiment or any variation in between. The tapering 39 of the side edges 16 combine with the second lateral edge 13 to form a generally blunt second lateral edge 13. In another embodiment, the tapering 39 of the side edges 16 in combination with the second lateral edge 13 may form a pointed second lateral edge 13 or any variation between pointed and blunt.

The preferred embodiment includes having generally pointed projections 30, 32 and generally pointed corners 31, 33 existing on both the first and second ends 12, 14. Although the preferred embodiment shows only a single set of generally pointed projections 30, 32 on each end 12, 14 of the depilatory device 10, any number of generally pointed projections 30, 32 could be utilized. It yet another alternate embodiment, the depilatory device 10 can be asymmetrical and utilize an odd or uneven number of generally pointed projections 30, 32 and generally pointed corners 31, 33.

In the preferred embodiment the depilatory device 10 is made of a resilient, flexible material to facilitate the deforming of the depilatory device 10 to conform to the contours of the body upon which hair removal is desired. In an alternate embodiment, the depilatory device 10 may be constructed of a rigid material when deformation and conformance to the contours of the body is not desired.

In the preferred embodiment the depilatory device 10 has a bottom surface 26 that is generally flat. In alternate embodiments the depilatory device 10 may have a bottom surface 26 that is curved.

Although the device has been described by reference to a specific embodiment, it should be understood that modifications and variations of the device may be constructed without departing from the scope of the device defined in the following claims.

What is claimed is:

1. A depilatory device comprising:

a body having a longitudinal length and a lateral width, the longitudinal length being greater than the lateral width;

the body having a bottom surface with an abrasive thereon;

the body having a top surface opposite the bottom surface;

the top surface having a monolithic finger hold;

the bottom surface having longitudinally opposite first and second ends; the first end having a lateral width dimension and the second end having a lateral width dimension; and the lateral width dimension of the first end being smaller than the lateral width dimension of the second end.

2. The device of claim 1, wherein:

the bottom surface has longitudinally opposite first and second lateral edges at the respective first and second ends of the bottom surface and side edges that extend longitudinally between the first lateral edge and the second lateral edge;

the first and second lateral edges and the side edges separate the top and bottom surfaces;

the bottom surface has a smallest lateral width dimension between the side edges; and the side edges of the bottom surface flare laterally outwardly and then taper laterally inwardly as the side edges of the bottom surface extend longitudinally from the smallest lateral width dimension of the bottom surface to the first lateral edge.

3. The device of claim 2, wherein:

the first lateral edge is a blunt edge.

4. The device of claim 2, wherein:

the side edges of the bottom surface form generally pointed projections at a location of a transition of the side edges of the bottom surface from flaring laterally outwardly to tapering laterally inwardly; and the side edges of the bottom surface form generally pointed corners at a location of a transition of the side edges to the first lateral edge.

5. The device of claim 2, wherein:

the side edges of the bottom surface flare laterally outwardly and then taper laterally inwardly as the side edges of the bottom surface extend longitudinally from the smallest lateral width dimension of the bottom surface to the second lateral edge.

6. The device of claim 5, wherein:

the second lateral edge is a blunt edge.

7. The device of claim 5, wherein:

the side edges of the bottom surface form generally pointed projections at a location of a transition of the side edges of the bottom surface from flaring laterally outwardly to tapering laterally inwardly; and the side edges of the bottom surface form generally pointed corners at a location of a transition of the side edges to the second lateral edge.

8. The device of claim 1, wherein:

the finger hold extends upwardly from the top surface of the body and tapers laterally inwardly as the finger hold extends upwardly from the top surface.

9. The device of claim 1, wherein:

the finger hold extends longitudinally along the top surface of the body and tapers laterally inwardly as the finger hold extends longitudinally.

10. The device of claim 1, wherein:

the finger hold extends upwardly from the top surface of the body and longitudinally along the top surface of the body and tapers laterally inwardly as the finger hold extends upwardly and tapers laterally inwardly as the finger hold extends longitudinally.

11. The device of claim 1, wherein:

the finger hold has a smallest lateral width dimension;

the finger hold extends longitudinally along the top surface of the body and flares laterally outwardly as the finger hold extends towards the first and second ends from the smallest lateral width dimension.

12. The device of claim 1, wherein:

the abrasive on the bottom surface of the body is provided by an abrasive sheet secured to the bottom surface.

13. The device of claim 12, wherein:

the bottom surface has longitudinally opposite first and second lateral edges at the respective first and second ends of the bottom surface and side edges that extend longitudinally between the first lateral edge and the second lateral edge;

the first and second lateral edges and the side edges separate the top and bottom surfaces;

the bottom surface has a smallest lateral width dimension between the side edges;

the side edges of the bottom surface flare laterally outwardly and then taper laterally inwardly as the side edges of the bottom surface extend longitudinally from the smallest lateral width dimension of the bottom surface to the first lateral edge;

the side edges of the bottom surface form generally pointed projections at a location of a transition of the side edges of the bottom surface from flaring laterally outwardly to tapering laterally inwardly; and the side edges of the bottom surface form generally pointed corners at a location of a transition of the side edges to the first lateral edge.

14. The device of claim 12, wherein:

the bottom surface has longitudinally opposite first and second lateral edges at the respective first and second ends of the bottom surface and side edges that extend longitudinally between the first lateral edge and the second lateral edge;

the first and second lateral edges and the side edges separate the top and bottom surfaces;

the bottom surface has a smallest lateral width dimension between the side edges;

the side edges of the bottom surface flare laterally outwardly and then taper laterally inwardly as the side edges of the bottom surface extend longitudinally from the smallest lateral width dimension of the bottom surface to the second lateral edge;

the side edges of the bottom surface form generally pointed projections at a location of a transition of the side edges of the bottom surface from flaring laterally outwardly to tapering laterally inwardly; and the side edges of the bottom surface form generally pointed comers at a location of a transition of the side edges to the second lateral edge.

15. The device of claim 2, wherein:

the bottom surface is generally flat.

16. A depilatory device comprising:

a body having a longitudinal length and a lateral width, the longitudinal length being greater than the lateral width;

the body having a bottom surface;

the body having a top surface opposite the bottom surface;

the top surface having a finger hold;

the finger hold is comprised of a plurality of laterally oriented webbed members separated by slots; and the finger hold has laterally opposite sides that taper.

17. The device of claim 16, wherein:

the finger hold extends upwardly from the body and tapers laterally inwardly as the finger hold extends upwardly.

18. The device of claim 16, wherein:

the finger hold extends longitudinally along the top surface of the body and the laterally opposite sides of the finger hold taper laterally inwardly as the finger hold extends longitudinally.

19. The device of claim 16, wherein:

the finger hold extends upwardly from the body and longitudinally along the top surface of the body and tapers laterally inwardly as the finger hold extends upwardly and tapers laterally inwardly as the finger hold extends longitudinally.

20. The device of claim 16, wherein:

the finger hold has a smallest lateral width dimension;

the finger hold extends longitudinally along the top surface of the body and flares laterally outwardly as the finger hold extends towards the first and second ends from the smallest lateral width dimension.

21. The device of claim 16, wherein:

the bottom surface is generally flat.

22. A depilatory device comprising:

a body having a longitudinal length and a lateral width, the longitudinal length being greater than the lateral width;

the body having an abrasive bottom surface;

the body having a top surface opposite the bottom surface;

the bottom surface having longitudinally opposite first and second ends;

the bottom surface having longitudinally opposite first and second lateral edges at the respective first and second ends of the bottom surface;

the bottom surface having laterally opposite side edges that extend longitudinally between the first and second lateral edges;

the bottom surface having a smallest lateral width dimension between the side edges;

the bottom surface flaring laterally outwardly and then tapering laterally inwardly as the bottom surface extends longitudinally from the bottom surface smallest lateral width dimension toward the first lateral edge.

23. The device of claim 22, wherein:

the bottom surface flares laterally outwardly and then tapers laterally inwardly as the bottom surface extends longitudinally from the bottom surface smallest lateral width dimension toward the second lateral edge.

24. The device of claim 23, wherein:

the bottom surface forms generally pointed projections at a location of a transition of the bottom surface from flaring laterally outwardly to tapering laterally inwardly; and the bottom surface forms generally pointed corners at a location of a transition of the side edges to the lateral edges.

25. The device of claim 24, wherein:

the bottom surface is generally flat.

26. The device of claim 25, wherein:

the abrasive bottom surface of the body is provided by an abrasive sheet secured to the bottom surface.

* * * * *